US005106079A

United States Patent [19]

Escobedo et al.

[11] Patent Number: 5,106,079

[45] Date of Patent: Apr. 21, 1992

[54] EXERCISE APPARATUS

[76] Inventors: Harold J. Escobedo, 10012 N. 87th Ave., Peoria, Ariz. 85345; Arthur D. Escobedo, P.O. Box 37, Solomon, Ariz. 85551

[21] Appl. No.: 615,499

[22] Filed: Nov. 19, 1990

[51] Int. Cl.[5] ..... A63B 21/06

[52] U.S. Cl. ..... 482/97; 482/141; 482/142; 482/137

[58] Field of Search ..... 272/117, 134, 143, 144, 272/145

[56] References Cited

U.S. PATENT DOCUMENTS 3,545,748 12/1970 Delinger ..... 272/117
3,573,866 4/1971 Madden ..... 272/117
4,332,381 6/1982 Lyons ..... 272/144
4,638,995 1/1987 Wilson ..... 272/143 X

FOREIGN PATENT DOCUMENTS 1477433 5/1989 U.S.S.R. ..... 272/134

*Primary Examiner*—Richard J. Apley
*Assistant Examiner*—D. F. Crosby
*Attorney, Agent, or Firm*—Cahill, Sutton & Thomas

[57] ABSTRACT

Exercise apparatus enables a person to perform extended push-ups with a variable and adjustable weight on his back. The apparatus includes a frame with elevated longitudinal members carrying handles near their forward ends. A weight platform is pivotally supported near the rear end of the frame. A locking arrangement manipulated by the feet of the user selectively locks or unlocks the weight platform against downward movement.

8 Claims, 2 Drawing Sheets

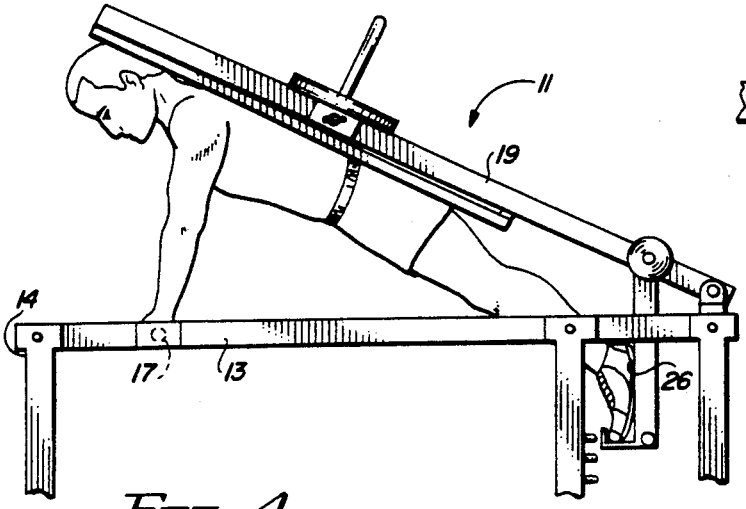
FIG. 4
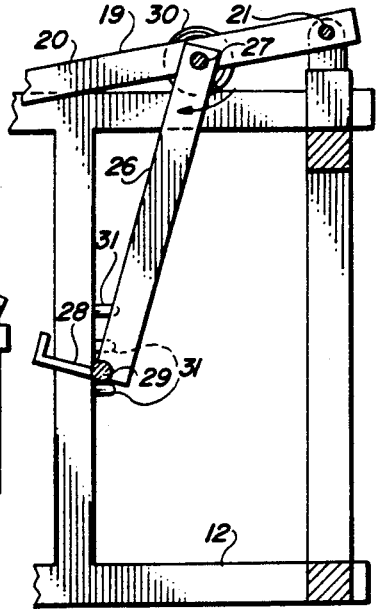
FIG. 5
FIG. 7
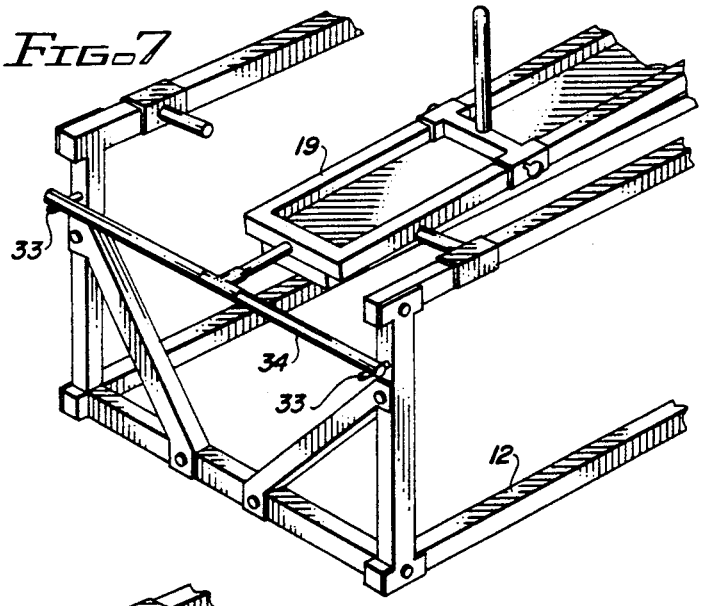
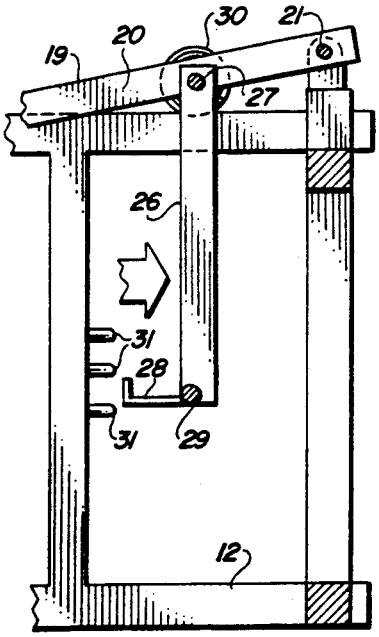
FIG. 6
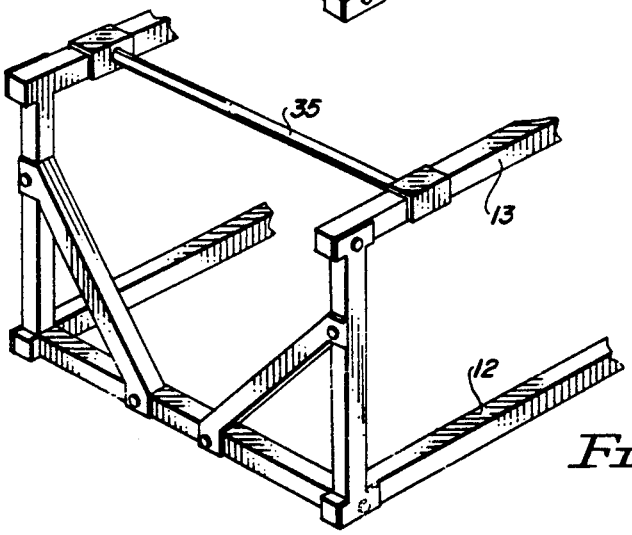
FIG. 8

EXERCISE APPARATUS

TECHNICAL FIELD

This invention is concerned with exercise apparatus which enables a person to derive additional benefits from the exercise known as "push-ups".

BACKGROUND ART

Push-ups are an exercise to develop the muscles of the chest, the arms, and the shoulders. Conventionally, push-ups have been performed by the user laying face down on a flat horizontal surface and raising and lowering his body by vertically extending and contracting his arms.

K. L. Jennings, Sr., in his U.S. Pat. No. 2,666,640 granted Jan. 19, 1954 for "Exercising Stand", discloses an appliance for raising the hands of the exerciser above the floor, thus allowing him to lower the upper portion of his body below the normal level of his shoulders when performing push-ups. His device extends the range of exercise movement to which the user can subject his body, preferably with favorable results.

An embellishment on the Jennings, Sr. apapratus is disclosed in U.S. Pat. No. 4,900,015, granted Feb. 13, 1990, to T. E. Dissinger, for "Exercise Device". This inventor provided a stand which requires the user to apply forces to the handgrips in the two different directions while performing push-ups.

With both of these prior art appliances, the user is working only against the weight of his own body. No provisions have been made for exercising against any greater weight.

DISCLOSURE OF THE INVENTION

The apparatus of this invention includes a frame for supporting handles in an elevated position above the supporting surface. Pivotally mounted on the frame in a position to rest on the back of the user of the apparatus is a weight-carrying platform. In executing push-ups, the user is not only working against his own body weight but also against the platform and any weights which have been placed thereon. There are provisions for changing and adjusting the position of the weights on the platform. The apparatus further includes a releasable mechanism for locking the weight platform against downward movement to permit the user to mount and dismount the apparatus.

BRIEF DESCRIPTION OF THE DRAWINGS

This invention is described in greater detail hereinafter by reference to the accompanying drawings, wherein:

FIGS. 3 and 4 are side elevational views illustrating the manner in which the apparatus is used;

FIGS. 5 and 6 are enlarged views of a platform locking mechanism employed in the apparatus; the mechanism is that portion of the apparatus within circle 5 in FIG. 2;

FIG. 7 is a fragmentary perspective view of an optional safety feature for the apparatus; and FIG. 8 is a fragmentary perspective view of a modified handle for the apparatus.

BEST MODES FOR CARRYING OUT THE INVENTION

Figure 1:
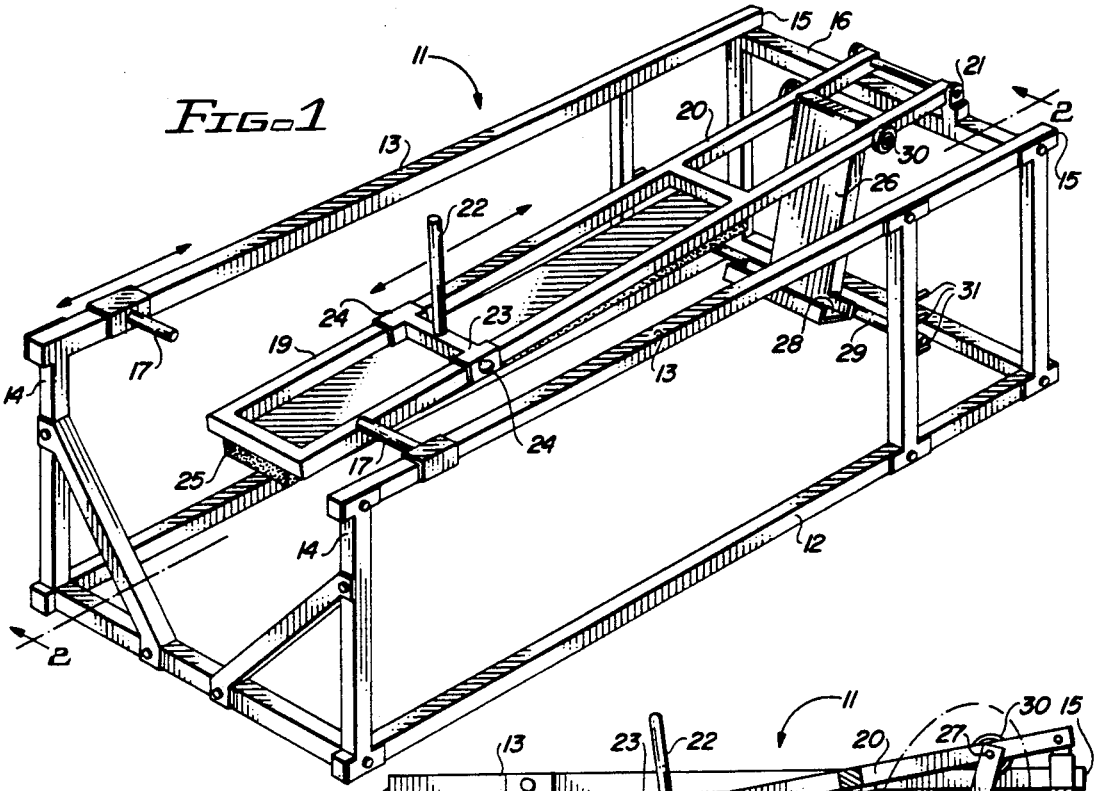
FIG. 1 is a perspective view of exercise apparatus embodying the invention.
Figure 2:
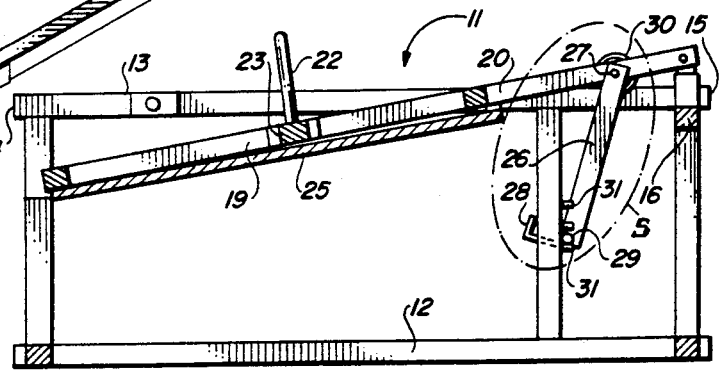
FIG. 2 is a vertical sectional view of the apparatus taken as indicated by the line 2—2 in FIG. 1.

Referring particularly to FIGS. 1 and 2, reference numeral 11 designates the exercise apparatus generally. This apparatus includes a box-like frame 12 having a pair of longitudinal rails 13 which are elevated with respect to the surface on which the apparatus rests. The upper forward end 14 of frame 12 is open while the upper rear end 15 is closed by transverse beam 16. The frame 12 is preferably fabricated from sections of metal tubing which are either bolted or welded together The exercise apparatus 11 includes hand grip means which in the mode shown in FIGS. 1 and 2 comprise a pair of handles 17 mounted on the rails 13 near the forward end 14 of frame 12. Handles 17 have channel supports 18 which rest on the rails 13 and permit the position of the handles to be adjusted along the rails.

Handles 17 are, of course, intended to be grasped in the hands of the user performing push-ups in the apparatus. To enhance the degree of exercise afforded the user, the apparatus includes means for applying weight to the back of the user during the push-up exercise.

The weight adding means takes the form of a weight platform 19. The platform 19 includes an elongated frame 20 pivotally mounted at 21 at its rear end on cross beam 16 at the rear end of frame 12. The platform 19 further includes adjustable weight holding means in the form of an upstanding post 22 mounted on a bracket 23 which is, in turn, mounted for sliding movement along the frame 20 of the platform. Post 22 can be locked in any desired position along platform frame 20 by tightening thumb screws 24. Weight post 22 on platform 19 is adapted to receive one or more conventional bar bell weights.

For the comfort of the user of the exercise apparatus 11, the weight platform 19 preferably includes an elongated cushioning pad 25 on its under surface.

The exercise apparatus 11 is further equipped with means for locking the weight platform 19 against downward movement to facilitate mounting and dismounting of the apparatus by the user. This platform locking means includes a foot board 26 pivotally supported at its upper end on a shaft 27 which passes through a rear portion of the frame 20 of weight platform 19. The lower edge of the foot board 26 carries a toe rest 28 and a transverse extension rod 29. Helical spring units 30 connected to the weight platform frame 20 and the foot board support shaft 27 biases the foot board forward, i.e., in a clockwise direction as viewed in FIG. 2. Positioned within the path of movement of foot board extension bar 29 are a series of stop pins 31 carried by the frame 12.

When the exercise appliance is unoccupied, springs 30 rotate foot board 26 to a position in which the extension rod 29 is over one of the stop pins 31. Engagement of the rod 29 with the pin 31 prevents downward movement of the weight platform 19. This condition of the locking mechanism, with the weight platform locked in an elevated position, is illustrated in FIG. 5.

Figure 3:
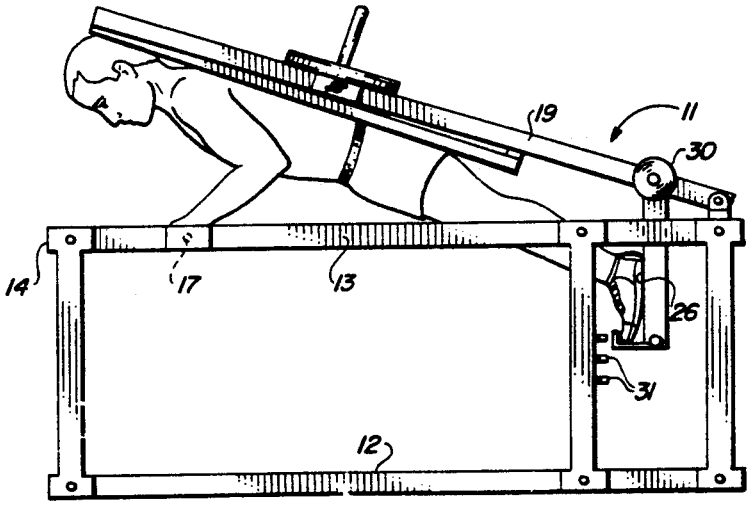

When a user mounts the apparatus 11 for exercise, he first positions himself, face down, beneath the weight platform 19 and grasps handles 17. When he is satisfied with his positioning and is ready to commence exercise, he places his feet against foot board 26 with his toes resting on toe rest 28. To release the locked weight platform, he then pushes rearwardly against the foot board to move the extension rod 29 away from stop pins 31. This condition of the locking mechanism in which the weight platform 19 is allowed free up and down movement is illustrated in FIG. 6. FIGS. 3 and 4 illustrate how a person performs push-ups in the apparatus 11.

To dismount the apparatus, the user simply steps free of foot board 26 while holding up the weight platform 19. He then slowly lowers the platform 19 until extension rod 29 contacts one of the stop pins 31. The weight platform 19 is thus locked in position and the user crawls free of the apparatus.

FIG. 7 illustrates an optional safety feature in another mode for carrying out the invention. Here, a pair of stop pins 33 are positioned on the front of frame 12 in the path of movement of a transverse safety bar 34 mounted at the forward end of weight platform 19. Stop pins 33, when engaged by safety bar 34, provide an absolute limit to downward movement of the weight platform 19. Thus, the weight platform is prevented from falling all the way to the ground, even though the locking mechanism involving extension rod 29 and stop pins 31 described above is not engaged.

A still further mode of carrying out the invention is illustrated in FIG. 8. Here, a unitary, continuous handle bar 35 replaces the handles 17 discussed above. Handle bar 35 permits the user of the apparatus to place his hands closer together to modify his exercise.

From the foregoing, it should be apparent that this invention provides an improved exercise apparatus which enables the user to derive greater benefit from push-up exercise.

What is claimed is:

1. Exercise apparatus comprising a frame having forward and rear ends, said frame further comprising a pair of longitudinal members elevated above a supporting surface, handle means mounted on said longitudinal members near the forward end of said frame, a weight carrying platform having forward and rear ends, the rear end of said platform being pivotally mounted on said frame near its rear end, and a foot rest positioned within said frame near its rear end, the arrangement being such that a person positioned face down beneath said weight platform with his feet on said foot rest and his hands on said handle means can raise and lower the weight platform by flexing his arms.

2. The exercise apparatus of claim 1, further characterized in that said handle means comprises a pair of handles mounted on said frame and projecting toward each other.

3. The exercise apparatus in claim 2, further characterized in that said handles are adjustable along said longitudinal members.

4. The exercise apparatus of claim 1, further characterized in that said foot rest is movable by movement of the feet of the user of the apparatus and the apparatus further comprises means for locking said weight platform against downward movement, said locking means being releasable by a user of the apparatus through movement of said foot rest.

5. The exercise apparatus of claim 4, further characterized in that said locking means comprises a stop engagable by an extension of said foot rest, spring means biasing said foot rest in a direction to cause said extension to engage said stop, said foot rest being movable in the opposite direction by a user of the apparatus to disengage said extension from said stop.

6. The exercise apparatus of claim 5, further characterized in that said foot rest is pivotally carried by said weight platform.

7. The exercise apparatus of claim 1, further characterized in that said weight platform further includes means for ad]ustably positioning a weight along at least a portion of the length thereof.

8. The exercise apparatus of claim 1, further comprising means for limiting the downward movement of said weight platform between said longitudinal members, said limiting means comprising an extension of the forward end of said weight platform and stop means positioned at the forward end of said frame in the path of movement of said extension.

* * * * *